US010648114B2

(12) United States Patent
Han

(10) Patent No.: US 10,648,114 B2
(45) Date of Patent: May 12, 2020

(54) WALL-MOUNTED WASHING MACHINE

(71) Applicant: Dongbu Daewoo Electronics Corporation, Seoul (KR)

(72) Inventor: Sang Ki Han, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 121 days.

(21) Appl. No.: 15/874,702

(22) Filed: Jan. 18, 2018

(65) Prior Publication Data

US 2018/0363190 A1 Dec. 20, 2018

(30) Foreign Application Priority Data

Jun. 15, 2017 (KR) ..... 10-2017-0075733

(51) Int. Cl.

| | |
|---|---|
| ***D06F 25/00*** | (2006.01) |
| ***D06F 18/00*** | (2006.01) |
| ***D06F 29/00*** | (2006.01) |
| ***D06F 58/24*** | (2006.01) |
| *D06F 58/02* | (2006.01) |
| *D06F 39/12* | (2006.01) |

(52) U.S. Cl.

CPC ..... *D06F 25/00* (2013.01); *D06F 18/00* (2013.01); *D06F 29/005* (2013.01); *D06F 58/24* (2013.01); *D06F 39/12* (2013.01); *D06F 58/02* (2013.01); *D06F 2226/00* (2013.01)

(58) Field of Classification Search

CPC ..... D06F 58/24; D06F 18/00; D06F 29/005; D06F 25/00; D06F 39/12; D06F 58/02; D06F 2226/00

See application file for complete search history.

(56) References Cited

U.S. PATENT DOCUMENTS

| | | | | |
|---|---|---|---|---|
| 6,564,594 | B1 * | 5/2003 | Ito | D06F 23/06 68/140 |
| 2014/0068873 | A1 * | 3/2014 | Lee | D06F 33/02 8/137 |
| 2014/0076007 | A1 * | 3/2014 | Hwang | D06F 37/22 68/140 |
| 2014/0083144 | A1 * | 3/2014 | Hwang | D06F 39/12 68/140 |
| 2014/0096569 | A1 * | 4/2014 | Hwang | D06F 39/12 68/139 |
| 2014/0102150 | A1 * | 4/2014 | Hwang | D06F 39/04 68/139 |
| 2014/0109622 | A1 * | 4/2014 | Hwang | D06F 39/12 68/16 |
| 2014/0109629 | A1 * | 4/2014 | Hwang | D06F 39/088 68/17 R |

(Continued)

*Primary Examiner* — Benjamin L Osterhout

(57) ABSTRACT

A wall-mounted washing machine with a built-in drying device operable to generate hot air during drying processes. The washing machine includes a rear panel configured to be affixed to a wall surface and support the tub. The rear panel includes one or more vent holes that allow hot air existing in a space between the rear panel and the housing of the washing machine to be discharged outside. By promptly removing hot air from the vicinity of the housing, the internal temperature of the washing machine can be effectively controlled and various components in the washing machine can be protected from unintended heating by the hot air.

8 Claims, 10 Drawing Sheets

(56) References Cited

U.S. PATENT DOCUMENTS

| | | | | |
|---|---|---|---|---|
| 2014/0292166 | A1* | 10/2014 | Hwang | D06F 39/12 312/228 |
| 2014/0298866 | A1* | 10/2014 | Hwang | D06F 39/12 68/139 |
| 2015/0176191 | A1* | 6/2015 | Hong | D06F 39/12 34/132 |

* cited by examiner

WALL-MOUNTED WASHING MACHINE

CROSS-REFERENCE TO RELATED APPLICATION

This application is based on and claims priority from Korean Patent Application No. 10-2017-0075733, filed on Jun. 15, 2017, the disclosure of which is incorporated herein in its entirety by reference for all purposes.

TECHNICAL FIELD

Embodiments of the present disclosure relate to wall-mounted washing machines, and, more particularly, to drying mechanisms in washing machines.

BACKGROUND

Wall-mounted washing machines can be installed and used on a wall or other vertical surfaces. They are usually designed in compact sizes and therefore are suitable for use in rooms of limited space.

A typical wall-mounted washing machine includes a cabinet, a tub movably disposed within the cabinet and configured to contain washing water, a drum rotatably installed in the tub and configured to accommodate laundry, a drive unit configured to supply driving power to the drum, a water supply device configured to supply washing water into the tub, and a water drain device configured to drain the washing water from the tub to the outside of the cabinet.

During a washing operation, washing water is supplied into the tub and the drum by operation of the water supply device. The drum is rotated by the drive unit and the washing items (e.g. laundry) contained therein rotate along. At the end of a washing process, washing water contained in the tub is drained to the outside of the cabinet through the water drain device by operation of the water drain device.

Some wall-mounted washing machines are equipped with a built-in drying device. The internal temperature of the washing machine can be increased by hot air generated by the drying device. Electronic parts inside the washing machine, such as various sensors and the like, tend to be impaired by their unintended heating. Thus, the operation of the drying device may cause operation errors which shorten the lifespan of the wall-mounted washing machine.

SUMMARY

Embodiments of the present disclosure provide a mechanism for controlling the internal temperature of a wall-mounted washing machine while a built-in dryer is in operation, and advantageously prevent malfunctioning and damage to the washing machine caused by heating.

In accordance with an embodiment, a wall-mounted washing machine includes: a rear panel capable of being hung on or otherwise affixed to a wall surface; a tub configured to contain washing water and supported by the rear panel; a drum rotatably installed inside the tub and configured to accommodate washing items (e.g. laundry); a tub front panel coupled to a front surface of the tub; and a housing coupled to the rear panel, wherein at least one vent hole is formed in the rear panel to penetrate the rear panel so that air between the housing and the rear panel can be discharged to the outside.

The vent hole may be formed in an upper portion of the rear panel.

The wall-mounted washing machine may further comprise a drying device coupled to an upper outer surface of the tub and configured to dry washing items (e.g. laundry), wherein the vent hole is formed in an upper portion of the rear panel opposed to the drying device.

In the wall-mounted washing, ribs are formed on a rear surface of the rear panel and serve to enhance the rigidity of the rear panel.

In the wall-mounted washing machine, protruding end portions of the ribs are at least partially cut away to form air circulation grooves.

In the wall-mounted washing, air present between the housing and the rear panel is moved toward a rear side of the rear panel through the vent hole and is then discharged to the outside through the air circulation grooves.

In the wall-mounted washing machine, the drying device includes a fan coupled to an upper portion of the tub and configured to propel air; a hot air supply duct coupled to the fan and configured to supply air into the tub; a drying heater provided inside the hot air supply duct and configured to heat air in the hot air supply duct; and a hot air discharge duct coupled to the tub and configured to guide air passing through the tub toward the fan.

In the wall-mounted washing machine, an end portion of the hot air supply duct on the side of the tub front panel is coupled to the front upper portion of the tub front panel, and an end portion of the hot air discharge duct on the side of the tub is coupled to the rear lower portion of the tub.

In the wall-mounted washing machine, a condensing water introduction port through which condensing water is introduced is disposed on one side of the hot air discharge duct. The condensing water introduced through the condensing water introduction port is used to remove moisture from the air passing through the hot air discharge duct.

In the wall-mounted washing machine, when the fan is operating, air is heated by the drying heater while the air moves along the hot air supply duct and is introduced into the tub through the tub front panel. Air passing through the tub is cooled and dehumidified by the condensing water while moving along the hot air discharge duct and is introduced into the fan.

The wall-mounted washing machine according to one embodiment of the present disclosure can discharge air from inside of a housing to the outside. This can advantageously prevent various problems caused by heating of the internal parts of the washing machine due to use of the built-in drying device.

DETAILED DESCRIPTION

Figure 1:
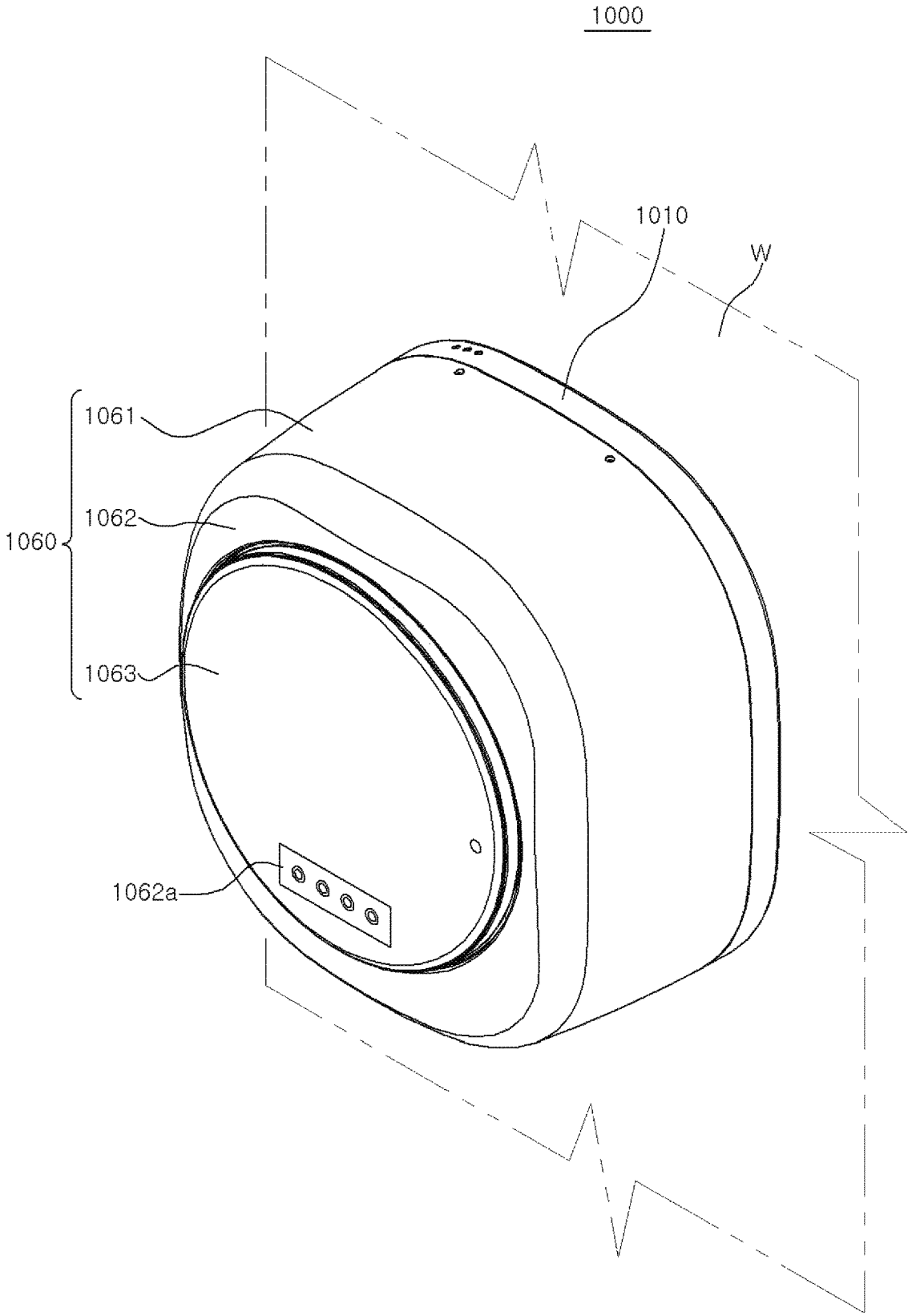
FIG. 1 is a front perspective view showing the configuration of an exemplary wall-mounted washing machine according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are not necessarily illustrated to scale. Relative sizes and proportions of parts in the drawings may be exaggerated or reduced in size, and a predetermined size is merely exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, may include modification of form due to manufacturing.

Preferred embodiments of the present disclosure are described in detail with reference to the accompanying drawings.

Figure 2:
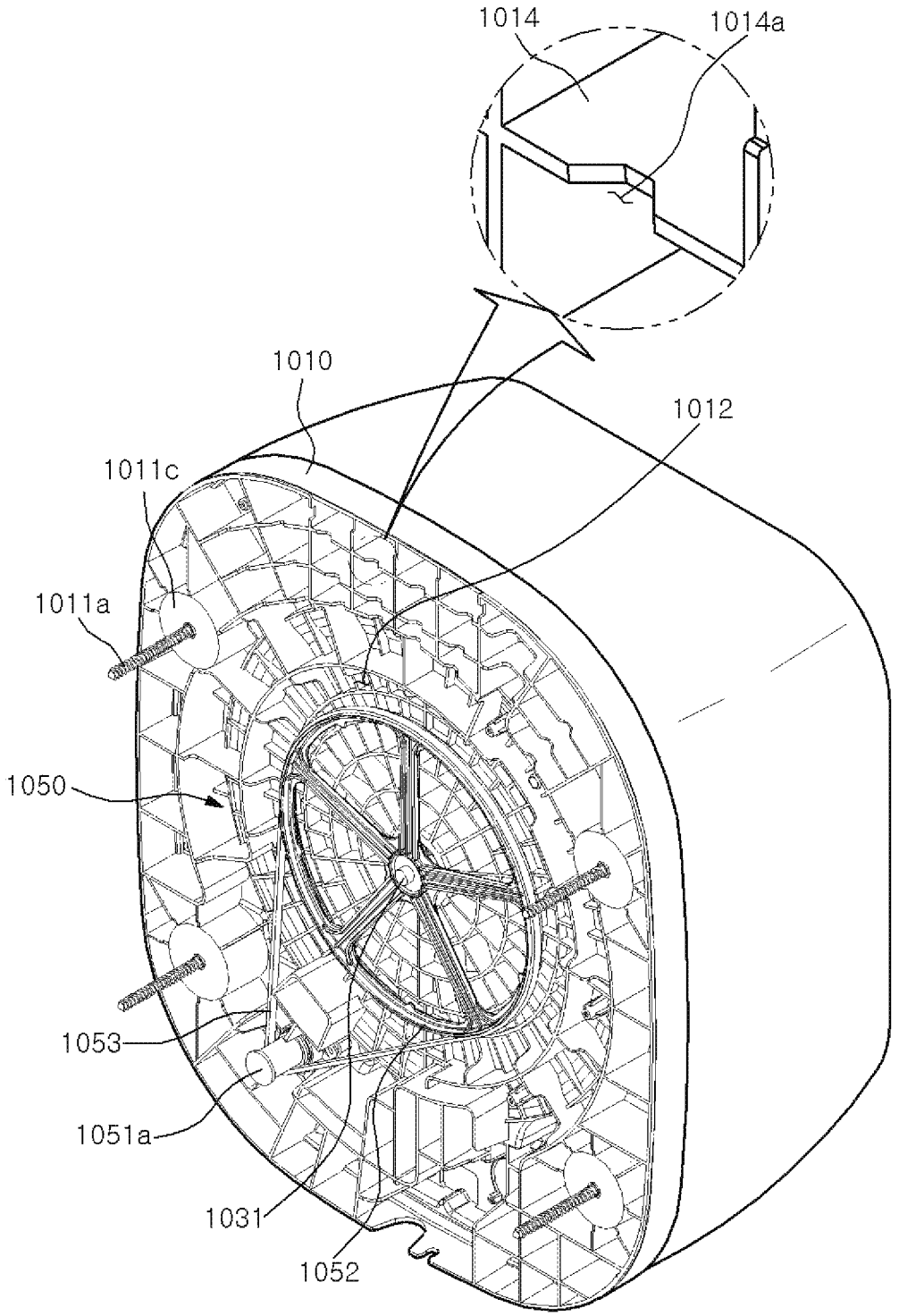
FIG. 2 a rear perspective view showing the exemplary wall-mounted washing machine according to one embodiment of the present disclosure.

FIG. 1 is a front perspective view showing the configuration of an exemplary wall-mounted washing machine according to one embodiment of the present disclosure. FIG. 2 a rear perspective view showing the configuration of the exemplary wall-mounted washing machine according to one embodiment of the present disclosure.

Referring to FIGS. 1 and 2, the wall-mounted washing machine 1000 according to one embodiment of the present disclosure can be hung on, or otherwise affixed to, a wall surface W. The wall-mounted washing machine 1000 may include a housing 1060 forming an outer shell, and a rear panel 1010 coupled to a rear surface of the housing 1060 and affixed to the wall surface W. The housing 1060 may include a side cover 1061 forming a side surface of the wall-mounted washing machine 1000, a front cover 1062 forming a front surface of the wall-mounted washing machine 1000, and a door 1063 rotatably coupled to the front cover 1062. A user may open the door 1063 to load and unload washing objects. Hereinafter, the detailed configuration of the wall-mounted washing machine 1000 according to one embodiment of the present disclosure is described with reference to FIGS. 3 to 10.

Figure 3:
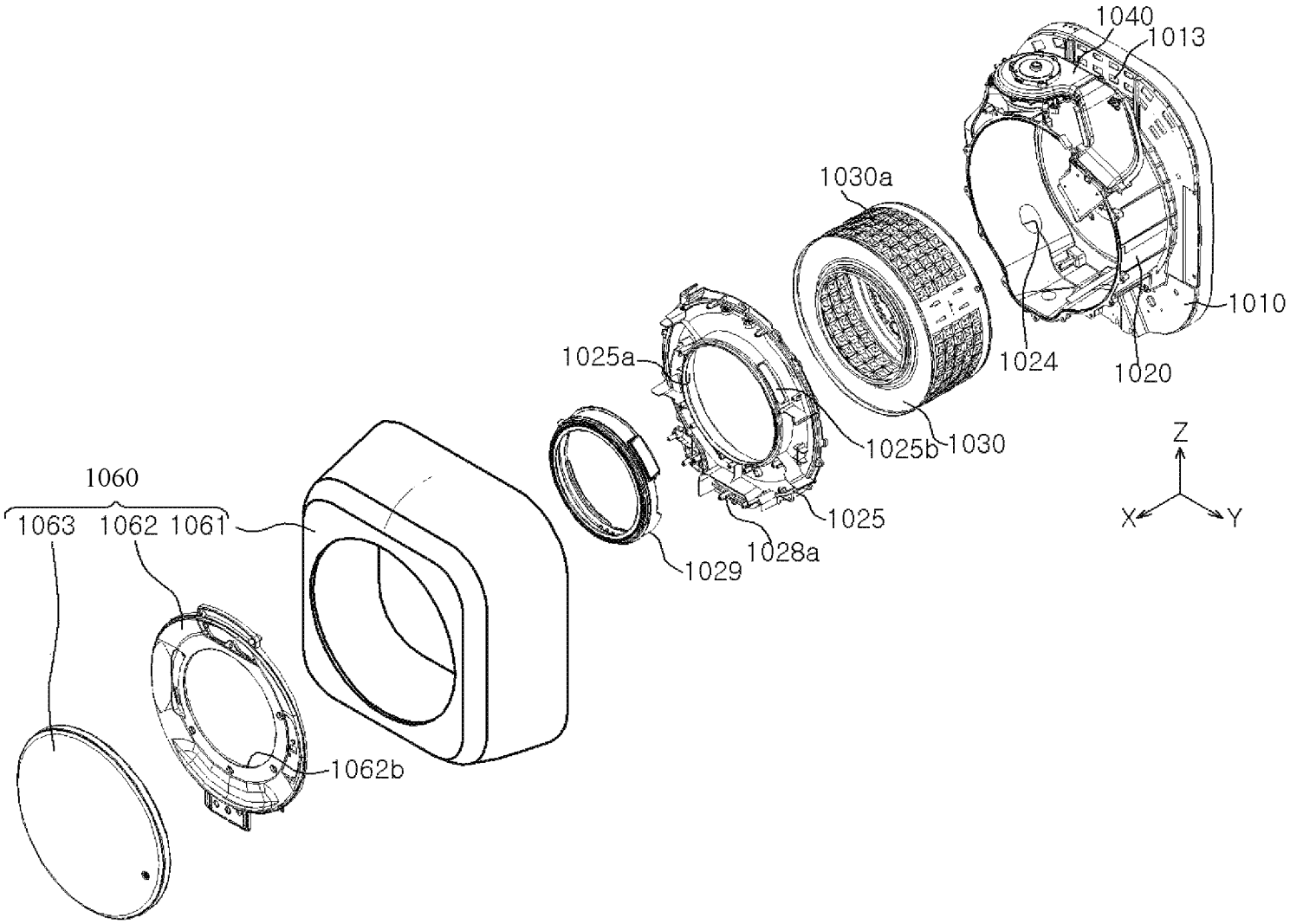
FIG. 3 is an exploded perspective view showing the configuration of the exemplary wall-mounted washing machine according to one embodiment of the present disclosure.
Figure 4:
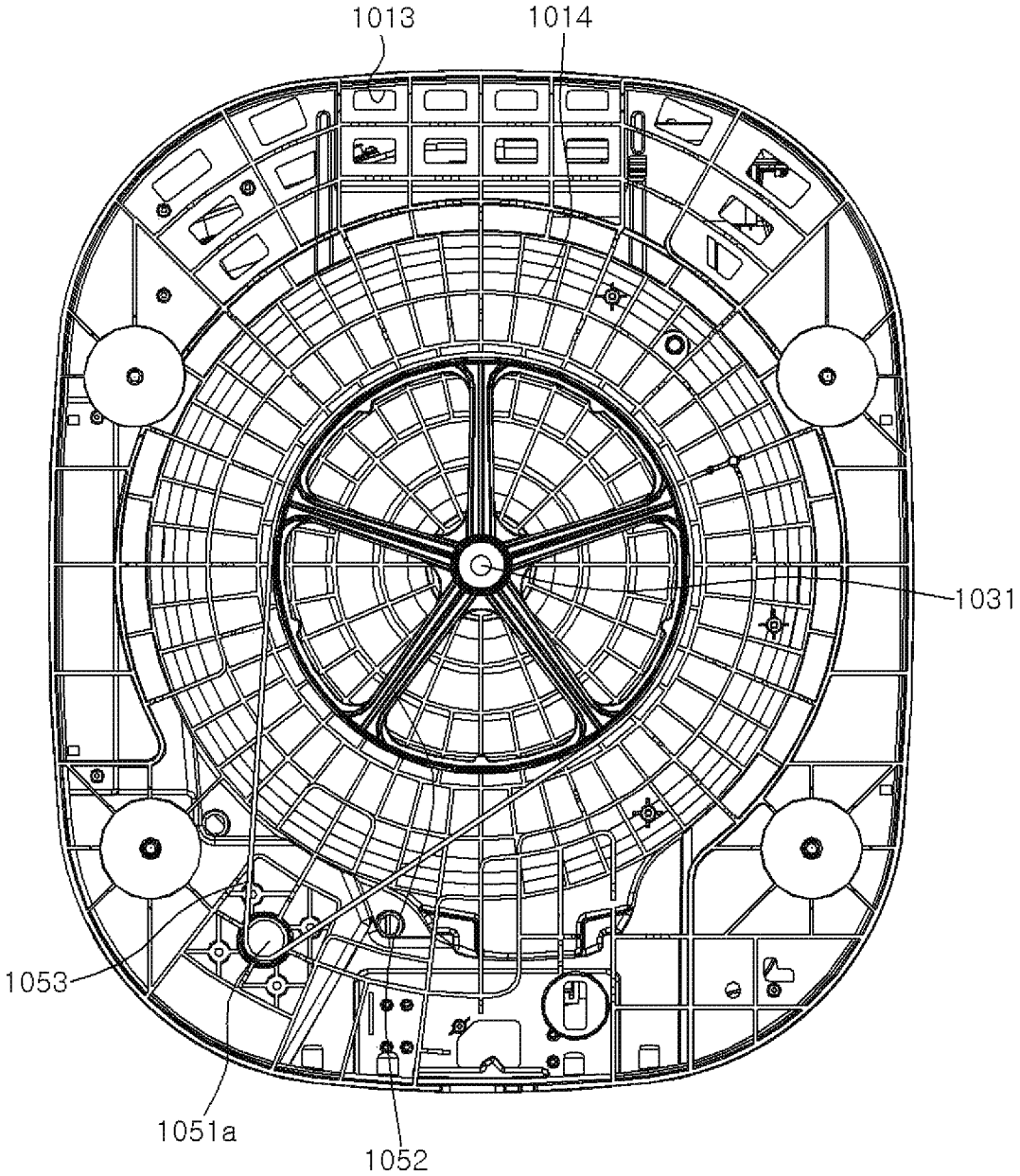
FIG. 4 is a rear view showing the configuration of the exemplary wall-mounted washing machine according to one embodiment of the present disclosure.
Figure 5:
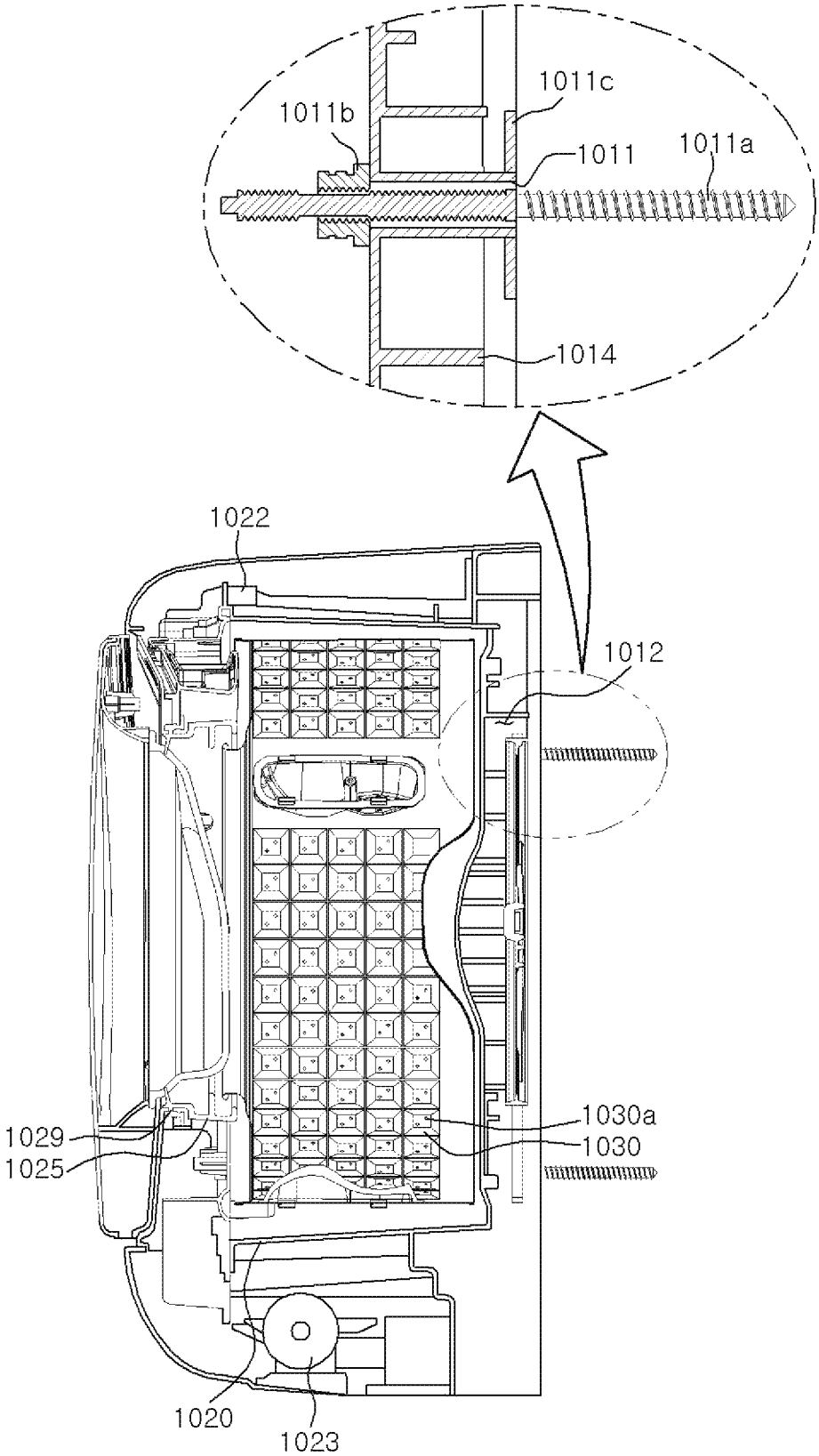
FIG. 5 is a sectional view showing a state in which the exemplary wall-mounted washing machine is mounted on a wall surface.
Figure 6:
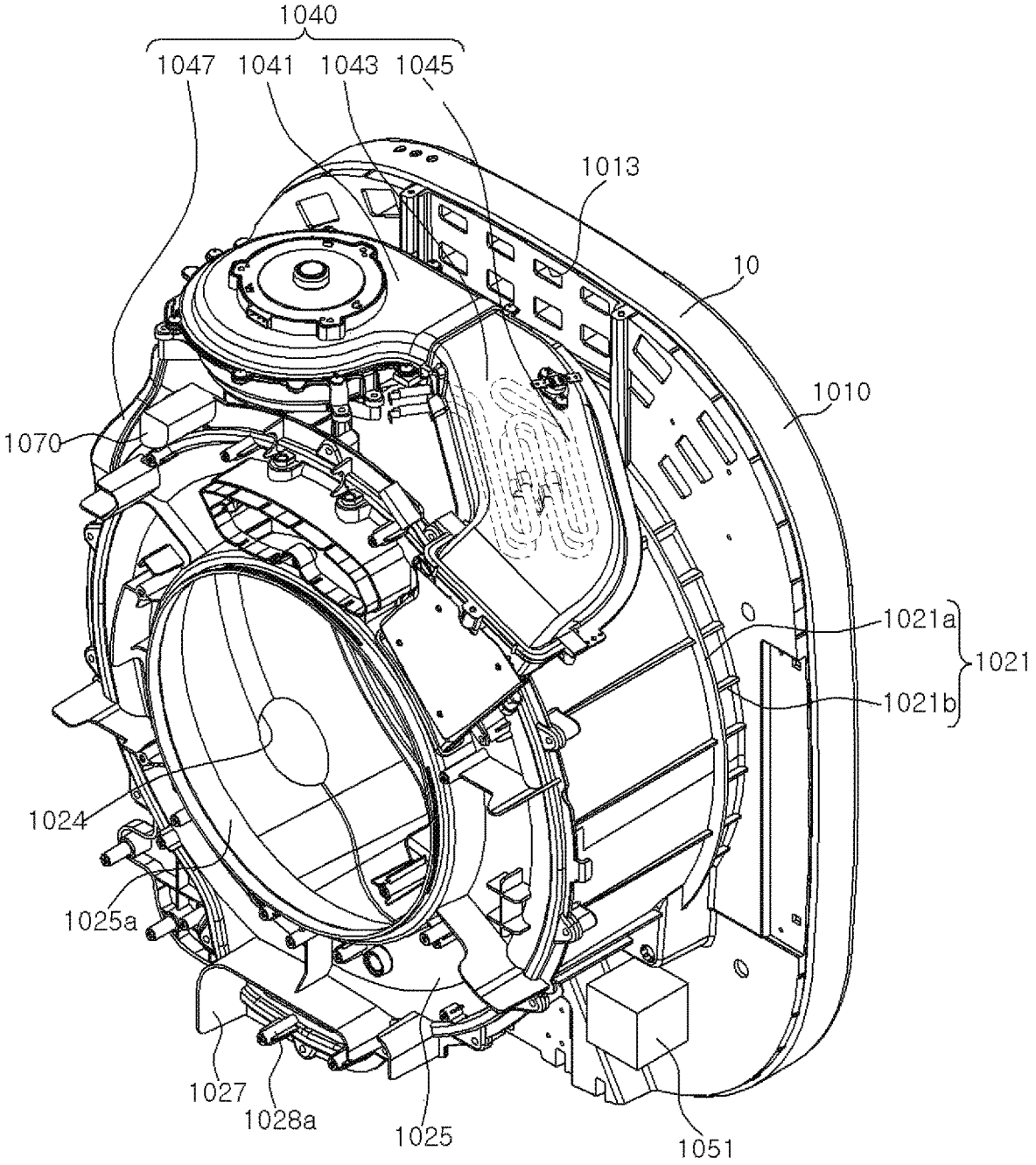
FIG. 6 is a perspective view showing the configuration of an exemplary rear panel and an exemplary tub according to one embodiment of the present disclosure.
Figure 7:
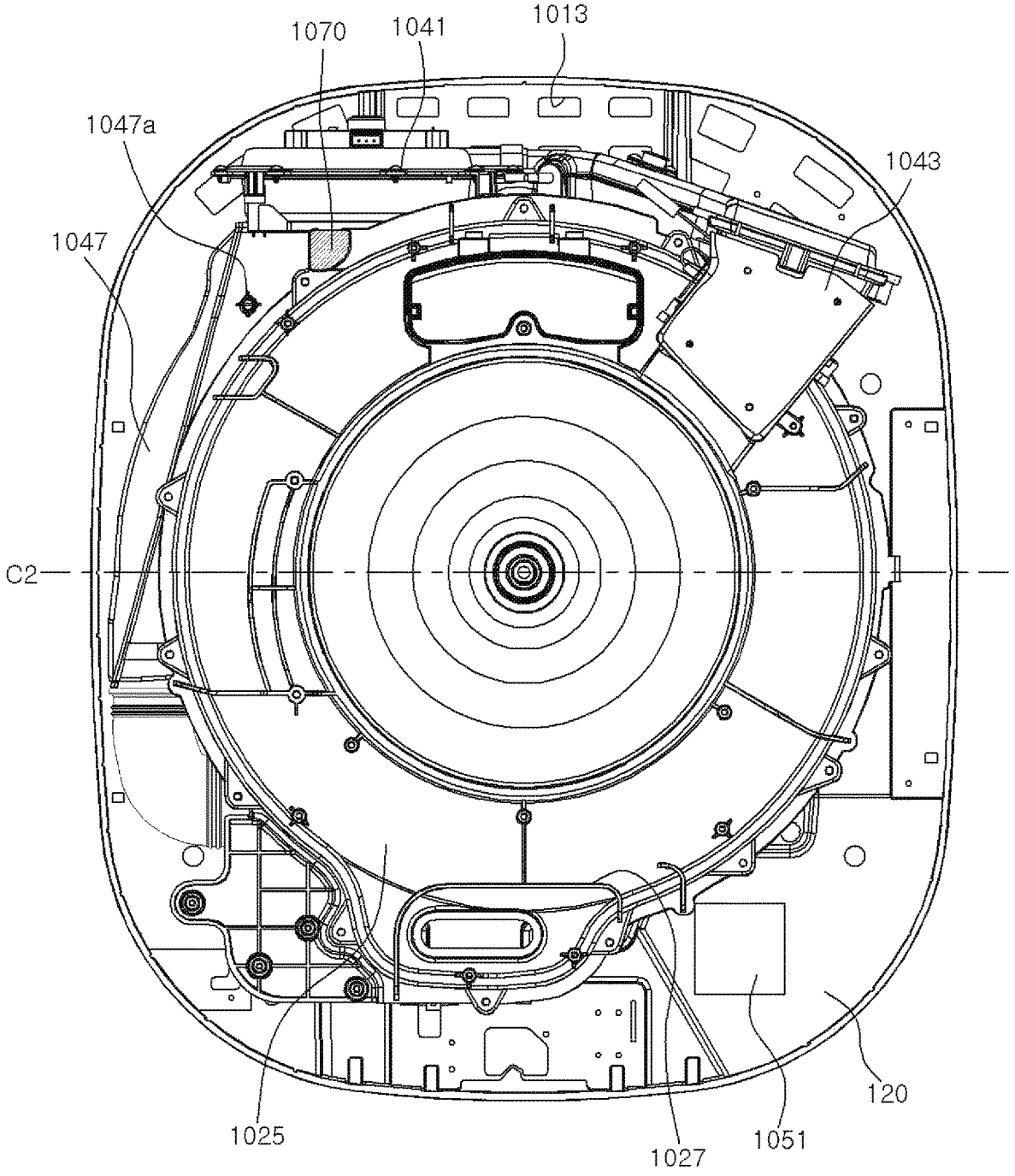
FIG. 7 is a front view of the exemplary rear panel and the exemplary tub shown in FIG. 6.
Figure 8:
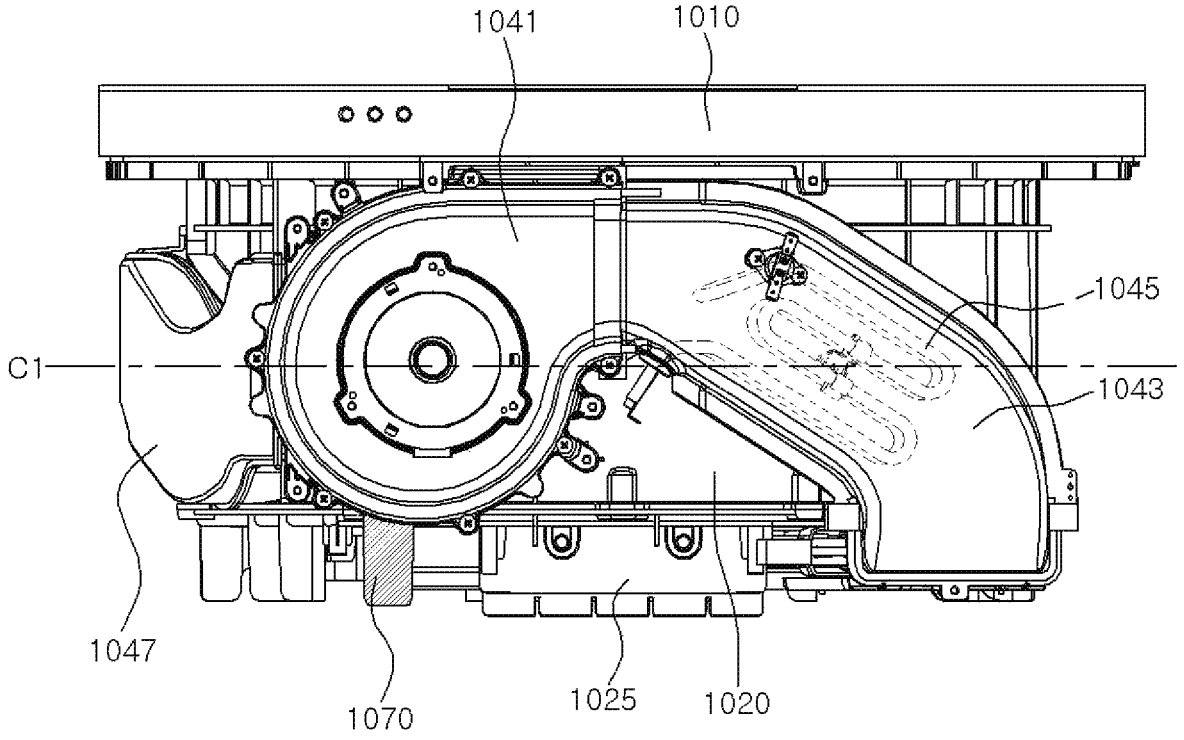
FIG. 8 is a plan view of the exemplary rear panel and the exemplary tub shown in FIG. 6.
Figure 9:
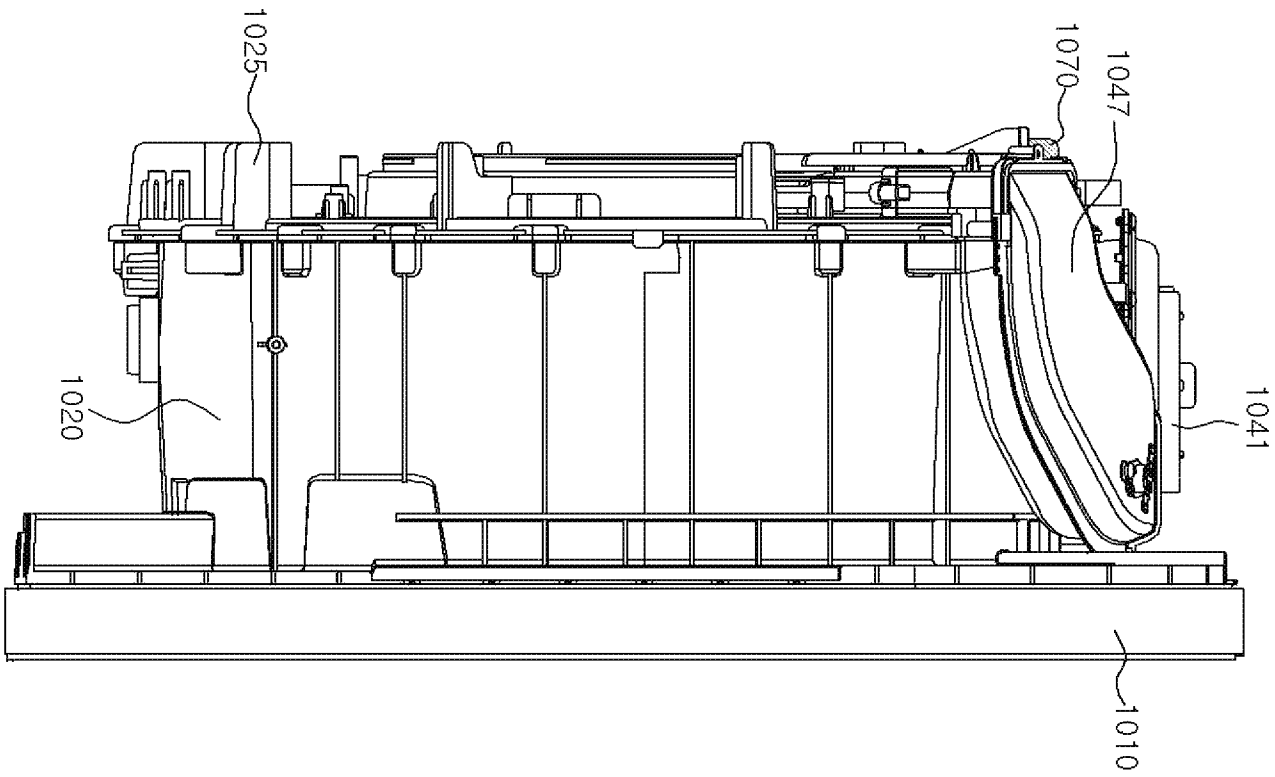
FIG. 9 is a right side view of the exemplary rear panel and the exemplary tub shown in FIG. 6.
Figure 10:
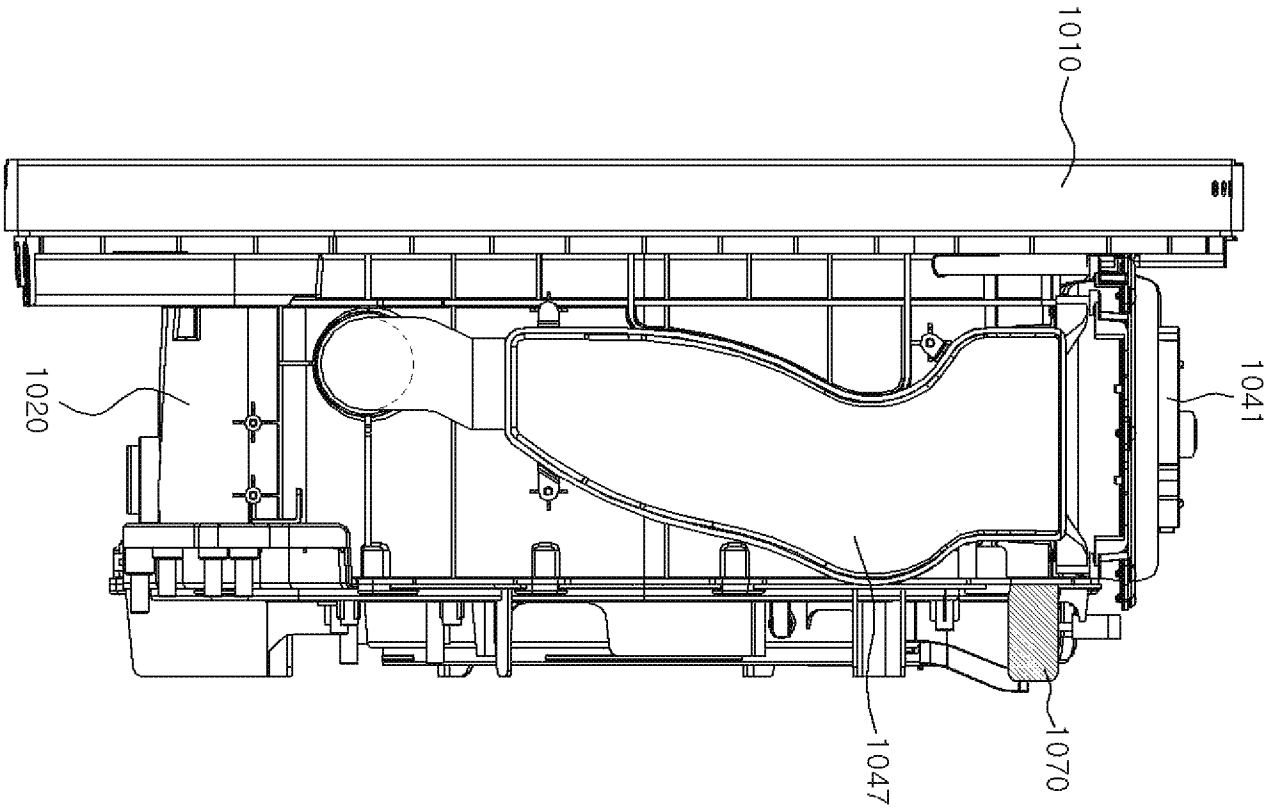
FIG. 10 is a left side view of the exemplary rear panel and the exemplary tub shown in FIG. 6.

FIG. 3 is an exploded perspective view showing the configuration of the exemplary wall-mounted washing machine according to one embodiment of the present disclosure. FIG. 4 is a rear view showing the configuration of the exemplary wall-mounted washing machine according to one embodiment of the present disclosure. FIG. 5 is a sectional view showing a state in which the exemplary wall-mounted washing machine is mounted on a wall surface. FIG. 6 is a perspective view showing the configuration of an exemplary rear panel and an exemplary tub according to one embodiment of the present disclosure. FIG. 7 is a front view of the exemplary rear panel and the exemplary tub shown in FIG. 6. FIG. 8 is a plan view of the exemplary rear panel and the exemplary tub shown in FIG. 6. FIG. 9 is a right side view of the exemplary rear panel and the exemplary tub shown in FIG. 6. FIG. 10 is a left side view of the exemplary rear panel and the exemplary tub shown in FIG. 6.

Referring to FIGS. 3 to 10, the wall-mounted washing machine 1000 according to one embodiment of the present disclosure may include a rear panel 1010 that can be affixed to a wall surface, a tub 1020 configured to contain washing water and can be supported by the rear panel 1010, a drum 1030 rotatably installed inside the tub 1020 and configured to accommodate washing objects, a drying device 1040 coupled to an outer surface of the tub 1020 and configured to dry the washing objects, a drive unit 1050 configured to supply power for rotating the drum 1030, and a housing 1060 coupled to the rear panel 1010 and serving as an outer shell of the wall-mounted washing machine 1000.

The rear panel 1010 may be hung on, or otherwise affixed to, the wall surface W. For example, the rear panel 1010 may be hung on the wall surface W by separate fastening members 1011*a*. To this end, through-holes 1011 penetrating the rear panel 1010 may be formed in the rear panel 1010 for the fastening members 1011*a* to be inserted into.

A method of hanging the rear panel 1010 on the wall surface W is described as follows. A user first installs the fastening members 1011*a* on the wall surface W and fits shock-absorbing members 1011*c* used for reducing shock and vibration to the fastening members 1011*a* that are produced during operations. Thereafter, the user hangs the rear panel 1010 on the wall surface W so that the fastening members 1011*a* are inserted into the through-holes 1011 of the rear panel 1010. Subsequently, nut members 1011*b* are coupled to the fastening members 1011*a* protruding forward from the rear panel 1010 via the through-holes 1011, whereby the rear panel 1010 can be hung on the wall surface W.

A mounting groove portion 1012 may be formed on the rear surface of the rear panel 1010, which provides a space for installing the drive unit 1050 between the rear panel 1010 and the wall surface W. During manufacturing, the mounting groove portion 1012 may be formed by depressing the rear surface of the rear panel 1010 by a predetermined depth.

At least one vent hole 1013 for air circulation may be formed in the rear panel 1010. For example, a plurality of vent holes 1013 penetrating the rear panel 1010 may be formed in the upper portion of the rear panel 1010. The vent holes 1013 allow air in the space surrounded by the rear panel 1010 and the housing 1060 to be discharged from the space, thereby preventing the air inside the wall-mounted washing machine 1000 from being heated. In other words, when the drying device 1040 is operating, air inside the wall-mounted washing machine 1000 may be heated by the fan 1041 and the drying heater 1045 of the drying device 1040, whereby the internal temperature of the wall-mounted washing machine may be increased undesirably. The increase in the internal temperature of the wall-mounted washing machine 1000 may cause an erroneous operation thereof and damage to the wall-mounted washing machine 1000. However, the wall-mounted washing machine 1000 according to one embodiment of the present disclosure may advantageously discharge hot air from the wall-mounted washing machine 1000 to the outside through the vent holes 1013 while preserving its drying capability. This can prevent various problems associated with the increase of the internal temperature in the wall-mounted washing machine 1000.

In the drawings, a plurality of vent holes 1013 are formed in a rectangular shape in the upper portion of the rear panel 1010 for efficient discharge of air. However, the present disclosure is not limited to this configuration. The positions and shapes of the vent holes may vary in different embodiments.

A plurality of ribs 1014 may be disposed on the rear surface of the rear panel 1010. The ribs 1014 may protrude from the rear surface of the rear panel 1010 to enhance the rigidity of the rear panel 1010. In this case, the end portions of the ribs 1014 may be partially cut away to form air circulation grooves 1014*a*. Due to the air circulation grooves 1014*a*, the air passing through the vent holes 1013 may be discharged outside.

If air passing through the vent holes 1013 of the rear panel 1010 is confined on the rear side of the rear panel 1010, the internal temperature of the wall-mounted washing machine 1000 can only be controlled to a limited level. It is advantageous to discharge the air in the vicinity of the rear panel 1010 to the outside. Thus, in the wall-mounted washing machine 1000 according to one embodiment of the present disclosure, air circulation grooves 1014*a* are formed in the ribs 1014 formed on the rear surface of the rear panel 1010. This allows air to discharge from the rear side of the rear panel 1010 to the outside. As a result, hot air inside the wall-mounted washing machine 1000 may move toward the rear side of the rear panel 1010 through the vent holes 1013 and can eventually discharge to the outside through the air circulation grooves 1014*a*. This configuration can effectively and advantageously limit any temperature increase to the internal temperature of the wall-mounted washing machine 1000.

The tub 1020 may be disposed on the front side of the rear panel 1010. During manufacturing, the tub 1020 may be simultaneously injection-molded with the rear panel 1010 and may be integrally formed with the rear panel 1010. Alternatively, the tub 1020 may be manufactured as a separate member and, then, later coupled to the rear panel 1010.

A water supply device 1022 and a water drain device 1023 may be coupled to the tub 1020. For example, the water supply device 1022 may be coupled to the upper portion of the tub 1020, and the water drain device 1023 may be coupled to the lower portion of the tub 1020. However, the coupling configurations of the water supply device 1022 and the water drain device 1023 may be implemented by using various other coupling mechanisms that are well known in the art.

The water supply device 1022 may be coupled to an external water supply source. When a user interacts with an operation unit 1062*a* to start a washing process, the water supply device 1022 may supply washing water into the tub 1020. The washing water supplied to the tub 1020 may enter the drum 1030 via washing water introduction holes 1030*a* formed on the outer surface of the drum 1030.

When a washing operation is completed, washing water may be drained to the outside via the water drain device 1023 installed under the tub 1020.

The drum 1030 may be rotatably coupled to the inside of the tub 1020. For example, a driving shaft 1031 may be coupled to the drum 1030. The driving shaft 1031 may be coupled to the drive unit 1050 disposed on the rear surface of the rear panel 1010, and the driving shaft 1031 can receive power from the drive unit 1050.

The drive unit 1050 may be coupled to the rear surface of the rear panel 1010 and operable to rotate the drum 1030. In this regard, the drive unit 1050 may be coupled to the mounting groove portion 1012 of the rear panel 1010. The mounting groove portion 1012 may be a depressed region formed on the rear surface of the rear panel 1010. The depression can prevent installation interference between the drive unit 1050 and the wall surface W.

As an example, the drive unit 1050 may include a motor 1051 having a rotating shaft 1051*a* and configured to supply power, a driving wheel 1052 coupled to the driving shaft 1031, and a belt 1053 coupled to the rotating shaft 1051*a* and the driving wheel 1052 to transmit power from the motor 1051 to the driving wheel 1052. Thus, when the motor 1051 rotates, the rotating shaft 1051*a* of the motor 1051 may rotate the belt 1053, whereby the driving wheel 1052 may be rotated to rotate the drum 1030.

Washing items may be accommodated inside the drum 1030. One or more washing water introduction holes 1030*a* may be formed on the outer surface of the drum 1030. Thus, the washing water supplied to the tub 1020 may be introduced into the drum 1030 via the washing water introduction holes 1030*a* to wash the washing objects.

Reinforcing ribs 1021 may be disposed in the rear portion of the tub 1020 where the tub 1020 and the rear panel 1010 make contact with each other. Herein, the term "front" may refer to the direction extending from the rear panel 1010 toward the tub 1020 with reference to FIG. 3, namely the positive X-axis direction. The term "rear" may refer to the direction extending from the tub 1020 toward the rear panel 1010 with reference to FIG. 3, namely the negative X-axis direction.

The reinforcing ribs 1021 may be formed along the outer circumferential surface of the rear portion of the tub 1020 and protrude radially outward. The reinforcing ribs 1021 may include first reinforcing ribs 1021*a* extending in the circumferential direction of the tub 1020 and second reinforcing ribs 1021*b* configured to couple the rear surfaces of the first reinforcing ribs 1021*a* with the front surface of the rear panel 1010. In this regard, the second reinforcing ribs 1021*b* may be disposed on the outer circumferential surface of the tub 1020 and spaced apart from one another in the circumferential direction. Some of the second reinforcing ribs 1021*b* may be formed to extend toward the front side of the tub 1020.

The reinforcing ribs 1021 may serve to distribute the stresses applied on the portion where the tub 1020 and the rear panel 1010 are coupled to each other. This can advantageously prevent damage of the tub 1020 or accidental separation of the tub 1020 from the rear panel 1010.

A tub front panel 1025 may be coupled to the front side of the tub 1020. The tub front panel 1025 may be coupled to the tub 1020 and form an internal space in which the drum 1030 is disposed. A detour rib 1027 may be disposed in the lower portion of the tub front panel 1025. The detour rib 1027 may protrude frontward from the front surface of the tub front panel 1025. The transverse opposite end portions of the detour rib 1027 may be bent downward into curved surfaces. As used herein, the term "transverse" may refer to the left-right direction when the wall-mounted washing machine 1000 is viewed from the front side, namely the Y-axis direction on the basis of FIG. 3.

A hot water heater power supply unit 1028*a* for supplying electric power to a hot water heater 1028 may be disposed under the detour rib 1027. The detour rib 1027 may prevent washing water flowing out from the interior of the wall-mounted washing machine 1000 from contacting the hot water heater power supply unit 1028*a*. In addition, an operation unit 1062*a* coupled to the housing 1060 (as described in greater detail below) may be disposed under the detour rib 1027. The detour rib 1027 may prevent the washing water from entering the operation unit 1062*a*.

An opening 1025*a* may be formed in the tub front panel 1025. A gasket 1029 for sealing may be coupled to the opening 1025*a* of the tub front panel 1025. In this case, the edge portion around opening 1025*a* of the tub front panel 1025 is configured in a step-like shape which can increase the coupling force with the gasket 1029. The gasket 1029 may seal a gap between the housing 1060 and the tub 1020 and may prevent foreign materials from entering a space between the tub front panel 1025 and the drum 1030. The gasket 1029 is fitted to the opening 1025*a* of the tub front panel 1025. At least a part of the outer circumferential surface of the gasket 1029 may make selective contact with the door 1063 (as described below), and the remaining part of the outer circumferential surface of the gasket 1029 may make close contact with the opening 1025*a*. For example, the gasket 1029 may have a diameter corresponding to the diameter of the opening 1025*a* of the tub front panel 1025. The gasket 1029 may have a ring-like shape with a center opening and may be made of a rubber material.

A hot air introduction port 1025*b* into which hot air discharged from a hot air supply duct 1043 of the drying device 1040 (as described later) is introduced may be formed in the front upper portion of the tub front panel 1025. The hot air introduced through the hot air introduction port 1025*b* may move toward the drum 1030 disposed inside the tub 1020. A drying process using hot air is described in greater detail below.

The drying device 1040 for drying the washing items may be disposed on the outer surface of the tub 1020. The drying device 1040 operates to dry the washing objects by supplying hot air into the tub 1020. The drying device 1040 can communicate with the front upper portion of the tub front panel 1025 and the rear lower portion of the tub 1020.

For example, the drying device 1040 may include a fan 1041 coupled to the upper portion of the tub 1020 and configured to propel air, a hot air supply duct 1043 coupled to the fan 1041 and configured to supply air into the tub 1020 through the hot air introduction port 1025*b* in the tub front panel 1025, a drying heater 1045 disposed inside the hot air supply duct 1043 and configured to heat air inside the hot air supply duct 1043, and a hot air discharge duct 1047 coupled to the tub 1020 and configured to guide air passing through the tub 1020 toward the fan 1041.

In the drying device 1040 disposed in the wall-mounted washing machine 1000 according to one embodiment of the present disclosure, the fan 1041, the hot air supply duct 1043, the tub 1020 and the hot air discharge duct 1047 may form an air circulation path. In other words, the drying device 1040 may perform a drying cycle by circulating air within the wall-mounted washing machine 1000.

A condensing water introduction port 1047*a* through which condensing water is introduced may be formed in the hot air discharge duct 1047.

Condensing water (not shown) injected into the hot air discharge duct 1047 through the condensing water introduction port 1047*a* may absorb and thereby remove air moisture in the hot air discharge duct 1047. Accordingly, air is cooled and dehumidified while passing through the hot air discharge duct 1047. In this state, the air may be re-introduced into the fan 1041.

A drying process using the drying device 1040 is described below. A drying operation can be activated as programmed following a washing operation or in response to a direct user command for drying. In a drying operation, the fan 1041 operates to push air to flow along the hot air supply duct 1043. Air flowing inside the hot air supply duct 1043 is heated by the drying heater 1045 and becomes hot air. The hot air is sequentially introduced into the tub 1020 and the drum 1030 through the tub front panel 1025. The hot air contacts and dries the washing items inside the drum 1030. Thereafter, the hot air used for drying the washing items is introduced into the hot air discharge duct 1047 through a hot air discharge port 1024 formed in the rear lower portion of the tub 1020. As described above, the hot air is dehumidified by the condensing water and is re-introduced into the fan 1041. Such process may be repeated during the drying operation.

To enhance drying efficiency of the drying device 1040, one end portion of the hot air supply duct 1043 may be coupled to the fan 1041. The other end portion of the hot air supply duct 1043, namely the end portion of the hot air supply duct 1043 on the side of the tub front panel 1025, to which the hot air is supplied, may be coupled to the front upper portion of the tub front panel 1025. In this case, the hot air supply duct 1043 may include a portion extending along the upper surface of the tub 1020 and a portion bent from the extended end portion toward the front surface of the tub 1020 and extending downward. Thus, the other end portion of the hot air supply duct 1043 may be coupled to the front surface of the tub front panel 1025.

Furthermore, one end portion of the hot air discharge duct 1047 may be coupled to the fan 1041. The other end portion of the hot air discharge duct 1047, namely the end portion of the hot air discharge duct 1047 on the side of the tub 1020, through which the hot air is introduced from the tub 1020 into the drying device 1040, may be coupled to the lower rear side of the side surface of the tub 1020. In other words, the other end portion of the hot air supply duct 1043 may be biased frontward on the basis of a centerline C1 shown in FIG. 8 and may be coupled to the tub front panel 1025 above a centerline C2 shown in FIG. 7. The other end portion of the hot air discharge duct 1047 may be biased rearward on the side surface of the tub 1020 on the basis of the centerline C1 shown in FIG. 8 and may be coupled to the tub 1020 below 'the centerline C2 shown in FIG. 7.

By coupling the hot air supply duct 1043 and the hot air discharge duct 1047 to the front upper portion of the tub 1020 and the lower rear side of the side surface of the tub 1020 as described above, hot air can be introduced from the hot air supply duct 1043 toward the front side of the tub 1020. After drying the washing objects accommodated in the tub 1020, the hot air is discharged through the hot air discharge duct 1047 on the rear side of the tub 1020. Thus, the hot air supplied to the tub 1020 through the drying device 1040 may be circulated through the interior of the drum 1030. Consequently, the drying efficiency of the washing objects is improved. A water level detecting sensor 1070 may be coupled to the tub front panel 1025 and may include, for example, a water pressure sensor. The water level detecting sensor 1070 may be coupled to a separate pipe branched from the water drain device 1023 of the tub 1020 and operate to measure the internal pressure of the tub 1020. The water level detecting sensor 1070 may measure the amount of washing water in the tub 1020 by sensing the internal pressure of the tub 1020.

As one example, the water level detecting sensor 1070 may be disposed in the front upper portion of the tub front panel 1025. In this case, the water level detecting sensor 1070 may be disposed more frontward than the drying device 1040 disposed above the tub 1020. More specifically, the fan 1041 in the drying device 1040 may be disposed more rearward than the water level detecting sensor 1070.

The reliability of the electronic components of the water level detecting sensor 1070 may be sensitive to heat. In other words, when the water level detecting sensor 1070 is subject to heat, it may malfunction or even become damaged. Accordingly, it is important to set the positional relationship between the water level detecting sensor 1070 and the drying device 1040 which includes the drying heater 1045 as a heat source.

In the wall-mounted washing machine 1000 according to one embodiment of the present disclosure, the water level detecting sensor 1070 may be disposed more adjacent to the fan 1041 than the hot air supply duct 1043 of the drying device 1040. In other words, the distance between the water level detecting sensor 1070 and the fan 1041 may be shorter than the distance between water level detecting sensor 1070 and the hot air supply duct 1043. In this regard, the distance between certain two members refers to the minimum distance between the two members. Generally, the water level detecting sensor 1070 may be biased toward the hot air discharge duct 1047 of the drying device 1040 with reference to the drying device 1040.

During operation of the drying device 1040, air passing through the fan 1041 of the drying device 1040 is moved along the hot air supply duct 1043 and is heated by the drying heater 1045. Thereafter, air passing through the tub 1020 and the drum 1030 is cooled and dehumidified by the condensing water while moving along the hot air discharge duct 1047. Thus, as the air is introduced into the fan 1041, it may have the lowest temperature among the whole air circulation lines of the drying device 1040. As a result, in the wall-mounted washing machine 1000 according to one embodiment of the present disclosure, overheating of the water level detecting sensor 1070 may be prevented by disposing the water level detecting sensor 1070 adjacent to the fan 1041.

The housing 1060 may be coupled to the rear panel 1010. The housing 1060 is coupled to the rear panel 1010 and forms an outer shell of the wall-mounted washing machine 1000. The housing 1060 may include a side cover 1061 opened at the front and rear sides thereof and coupled to the rim of the rear panel 1010 on the rear side thereof, a front cover 1062 coupled to the open front side of the side cover 1061 and having an opening 1062*b*, and a door 1063 rotatably coupled to the front cover 1062 and configured to selectively close and open the opening 1062*b*.

An operation input unit 1062*a* may be disposed in the front cover 1062. The operation input unit 1062*a* enables a user to control the wall-mounted washing machine 1000. Buttons of the operation unit 1062*a* may be exposed through the front cover 1062. The operation input unit 1062*a* may be entirely disposed under the detour rib 1027 formed in the tub front panel 1025 described above. Thus, washing water leaked from the interior of the wall-mounted washing machine 1000 may flow along the detour rib 1027 without entering the operation unit 1062*a*.

The door 1063 covers the opening 1062*b* of the front cover 1062. For example, the door 1063 may be coupled to the front cover 1062 via the door hinge 1063*a*. A user may close or open the door 1063 using a handle of the door 1063. Alternatively, the door 1063 may be an electronic door opened or closed in a one touch manner through the use of an operation button in the front cover 1062.

In the wall-mounted washing machine 1000 according to one embodiment of the present disclosure described above, the water level detecting sensor 1070 is disposed on the side of the fan of the drying device 1040. This can advantageously prevent malfunctioning or damage of the water level detecting sensor 1070 due to the heat generated by the drying device 1040.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A washing machine comprising:

a rear panel configured to be affixed to a surface of a wall;

a tub coupled to and supported by the rear panel and configured to contain washing water;

a drum rotatably installed inside the tub and configured to accommodate washing items;

a tub front panel coupled to a front of the tub;

a housing coupled to the rear panel; and a drying device coupled to an upper outer surface of the tub and configured to dry the washing items, wherein at least one vent hole is disposed in the rear panel and penetrates the rear panel, wherein the at least one vent hole is configured to allow air in a space between the housing and the rear panel to be discharged out from the space, wherein the drying device comprises:

a fan coupled to an upper portion of the tub and configured to propel air;

a hot air supply duct coupled to the fan and configured to supply air into the tub;

a drying heater disposed inside the hot air supply duct and configured to heat inside of the hot air supply duct; and a hot air discharge duct coupled to the tub and configured to guide air passing through the tub toward the fan, wherein a condensing water introduction port configured to introduce condensing water is disposed on one side of the hot air discharge duct, and wherein air passing through the hot air discharge duct is dehumidified by condensing water introduced through the condensing water introduction port.

2. The washing machine of claim 1, wherein the at least one vent hole is formed in an upper portion of the rear panel.

3. The washing machine of claim 1, further comprising:

wherein the at least one vent hole is disposed in an upper portion of the rear panel opposite the drying device.

4. The washing machine of claim 1, wherein a rear surface of the rear panel comprises ribs configured to enhance rigidity of the rear panel.

5. The washing machine of claim 4, wherein the ribs comprise protruding end portions and at least a portion of the protruding end portion is partially cut away as air circulation grooves.

6. The washing machine of claim 5, wherein a path is provided for air existing between the housing and the rear panel to flow toward a rear side of the rear panel through the at least one vent hole and become discharged to the outside through the air circulation grooves.

7. The washing machine of claim 3, wherein an end portion of the hot air supply duct on a side of the tub front panel is coupled to the front upper portion of the tub front panel, and wherein an end portion of the hot air discharge duct on a side of the tub is coupled to a rear lower portion of the tub.

8. The washing machine of claim 1, wherein when the fan is operational, air is heated by the drying heater while moving along the hot air supply duct and is introduced into the tub through the tub front panel, and wherein air passing through the tub is cooled and dehumidified by the condensing water while moving along the hot air discharge duct and is introduced into the fan.

* * * * *